US006368551B1

(12) United States Patent
Sekine et al.

(10) Patent No.: US 6,368,551 B1
(45) Date of Patent: Apr. 9, 2002

(54) METHOD FOR PREPARATION OF SINTERED PERMANENT MAGNET

(75) Inventors: Shigenobu Sekine; Yuko Kawasaki; Yoshiki Kuwabara; Hiroji Sato; Minoru Narita; Kazushi Suzuki; Koichi Tono, all of Tokyo; Keiji Okada, Kamagaya; Kenji Sakaguchi, Tokyo; Mitsuhisa Hirata, Funabashi, all of (JP)

(73) Assignee: Sanei Kasei Co., Ltd., Tokyo (JP)

( * ) Notice: Subject to any disclaimer, the term of this patent is extended or adjusted under 35 U.S.C. 154(b) by 0 days.

(21) Appl. No.: 09/641,136

(22) Filed: Aug. 16, 2000

(30) Foreign Application Priority Data

Jun. 22, 2000 (JP) ..... 2000-187453
Aug. 17, 2000 (JP) ..... 11-230282

(51) Int. Cl.[7] ..... B22F 3/12

(52) U.S. Cl. ..... 419/12; 419/60; 148/103; 148/302

(58) Field of Search ..... 419/12, 39, 60; 148/103, 302

(56) References Cited

U.S. PATENT DOCUMENTS 4,770,723 A 9/1988 Sagawa et al. ..... 148/302
4,792,368 A 12/1988 Sagawa et al. ..... 148/302
4,840,684 A 6/1989 Fujimura et al. ..... 148/302
4,891,078 A * 1/1990 Ghandehari ..... 148/301
4,952,252 A 8/1990 Ghandehari ..... 148/105
5,096,512 A 3/1992 Sagawa et al. ..... 148/302
5,183,516 A 2/1993 Sagawa et al. ..... 148/302
5,194,098 A 3/1993 Sagawa et al. ..... 148/302
5,194,099 A 3/1993 Esper et al. ..... 148/302
5,466,308 A 11/1995 Fujimura et al. ..... 148/302
5,645,651 A 7/1997 Fujimura et al. ..... 148/302
5,942,053 A 8/1999 Sekine et al. ..... 148/302

FOREIGN PATENT DOCUMENTS

JP 7-78269 8/1995

* cited by examiner

*Primary Examiner*—Ngoclan Mai
(74) *Attorney, Agent, or Firm*—Manelli Denison & Selter PLLC; Paul E. White, Jr.

(57) ABSTRACT

The method for preparation of sintered permanent magnets according to the present invention comprises the steps of: mixing fully fine powder of a crystalline mother alloy for permanent magnet containing a rare-earth element, Fe and B as the essential components with fine powder of zinc oxide, compaction molding the resulted mixture in the presence of a magnetic field, sintering the compacted mixture in vacuum to cause generation of oxygen and metallic zinc by thermal decomposition of the zinc oxide; segregation of a part of metallic component in the mother alloy at the boundary and inside of the mother alloy crystal; formation of amorphous metallic oxide by forced oxidation of the segregated metal with the generated oxygen; crystallization of the amorphous metallic oxide; formation of an epitaxial junction between the crystallized metallic oxide and the mother alloy crystal; and evaporation of the metallic zinc into the vacuum, and quenching the sintered compact.

14 Claims, 4 Drawing Sheets

METHOD FOR PREPARATION OF SINTERED PERMANENT MAGNET

FIELD OF THE INVENTION

The present invention relates to a method for preparation of sintered permanent magnets superior in magnetic properties.

BACKGROUND OF THE INVENTION

Japanese Patent Publication Hei 7-78269 (Japanese patent application Sho58-94876, the patent families include U.S. Pat. Nos. 4,770,723; 4,792,368; 4,840,684; 5,096,512; 5,183,516; 5,194,098; 5,466,308; 5,645,651) discloses (a) RFeB compounds for permanent magnet containing R (at least one kind of rare earth elements including Y), Fe and B as the essential components, and having a tetragonal crystal structure with the lattice constant $C_0$ of about 12 Å, and each crystal grain being separated by a non-magnetic phase; or (b) RFeBA compounds for permanent magnet containing R, Fe, B and element A (Ti, Ni, Bi, V, Nb, Ta, Cr, Mo, W, Mn, Al, Sb, Ge, Sn, Zr, Hf, Cu, S, C, Ca, Mg, Si, O or P) as the essential components, having a tetragonal crystal structure with the lattice constant $C_0$ of about 12 Å, and each crystal grain being separated by a non-magnetic phase. It is mentioned that the permanent magnet exhibits specifically superior properties when the above-mentioned tetragonal compounds have appropriate crystal grain sizes, the compounds constitute the major phase, and microstructures containing R-rich non-magnetic phases are formed.

According to Example 2 of the Japanese patent publication Hei 7-78269, for example, an alloy of 8 atomic % B, 15 atomic % Nd and the balance Fe was pulverized to obtain alloy powder having average particle size of 3 $\mu$m. The powder was compacted under 2t/cm$^2$ pressure in a magnetic field of 10 kOe, and then sintered at 1100° C. for 1 hour in Ar of $2\times10^{-1}$ Torr. The permanent magnet obtained showed Br=12.1 kG, Hc=9.3 kOe, and (BH)max=34 MGOe. It is disclosed that the major phase (magnetic phase) of the sintered compact was a tetragonal compound containing simultaneously Fe, B and Nd, having lattice constants of $A_0$=8.80 Å and $C_0$=12.23 Å, occupying 90.5 volume % of the sintered compact, and that among the non-magnetic phase separating the tetragonal compounds and forming grain boundaries of the major phase, a non-magnetic compound phase containing more than 80% of R occupied 4 volume % and the remainder was virtually oxides and pores.

Though the magnet showed excellent magnetic properties, latent abilities of the RFeB or RFeBA tetragonal compounds have not been exhibited fully. This may be reasoned on insufficient orientation of the tetragonal compounds toward the major axis direction, because the phase containing a large amount of R constituting the non-magnetic phases for separating mutually the major phases composed of the tetragonal compounds is amorphous.

SUMMARY OF THE DISCLOSURE

The object of the invention is to provide a method for preparation of sintered permanent magnets having excellent magnetic properties by exhibiting fully latent abilities of the mother alloy for permanent magnet having a rare earth element, Fe and B as the essential components.

The method for preparation of sintered permanent magnets according to the present invention comprises the steps of: mixing fully fine powder of a crystalline mother alloy for permanent magnet containing a rare-earth element, Fe and B as the essential components with fine powder of zinc oxide, compaction molding the resulted mixture in the presence of a magnetic field, sintering the compacted mixture in vacuum to cause generation of oxygen and metallic zinc by thermal decomposition of the zinc oxide; segregation of a part of metallic component in the mother alloy at the boundary and inside of the mother alloy crystal; formation of amorphous metallic oxide by forced oxidation of the segregated metal with the generated oxygen; crystallization of the amorphous metallic oxide; formation of an epitaxial junction between the crystallized metallic oxide and the mother alloy crystal; and evaporation of the metallic zinc into the vacuum, and quenching the sintered compact.

DETAILED DESCRIPTION OF THE PREFERRED EMBODIMENTS

Figure 1:
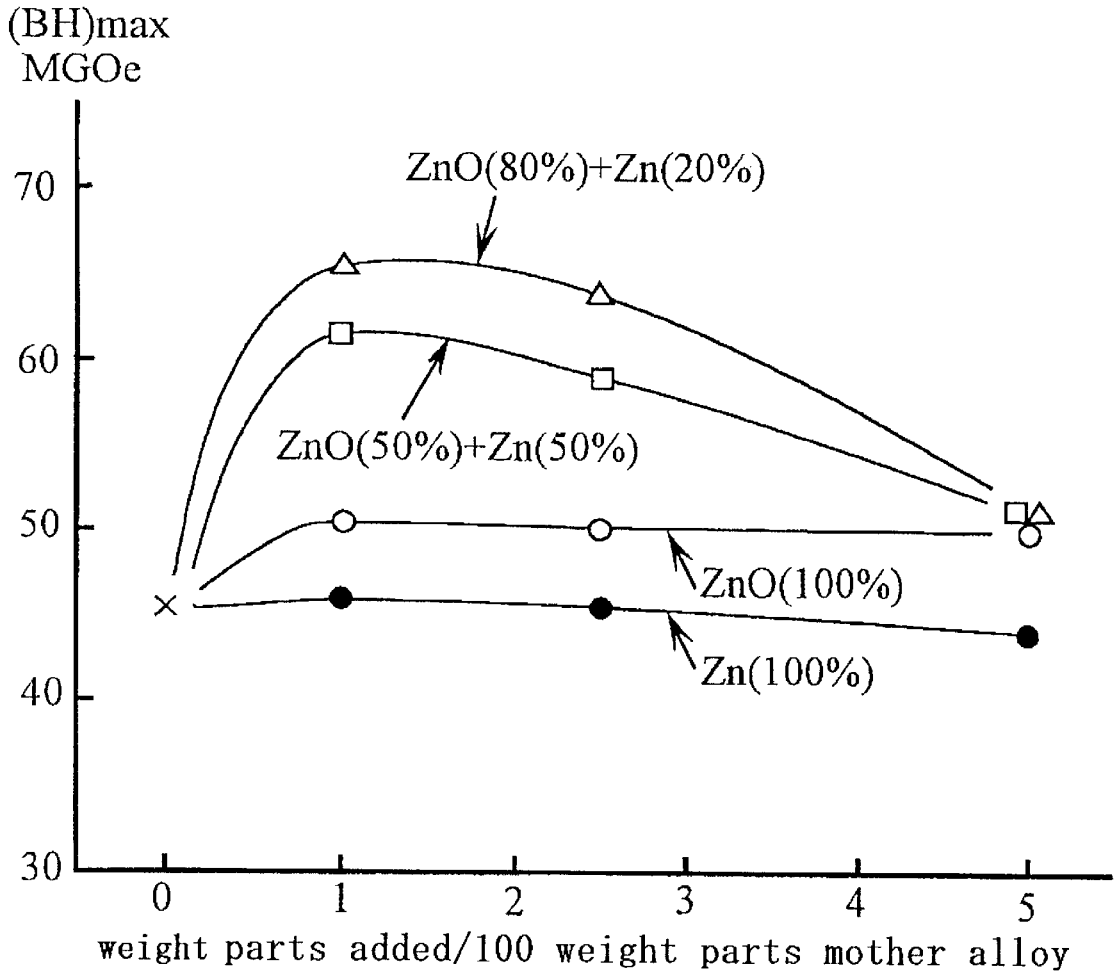
FIG. 1 is a graph showing magnetic properties of the sintered permanent magnet obtained by Examples 1–9 and Comparative Examples 1–4, in which the abscissa indicates the amount (weight parts) of zinc oxide, mixtures of zinc oxide and zinc or zinc added to 100 weight parts of the mother alloy, and the ordinate indicates the maximum energy product (BH)max.

The mother alloy for permanent magnets to be used in present invention is the one containing Nd, Fe and B as the essential component, and a portion of the Fe may be replaced with such other transition metals as Co and Ni. Especially preferred is a NdFeB compound or a NdFeCoB compound having tetragonal crystal structure with the lattice constant $A_0$ of about 8.8 Å and $C_0$ of about 12 Å as the major phase.

In the method, better results are obtained by mixing the fine powder of mother alloy for permanent magnet with a mixture of zinc oxide fine powder and metallic zinc fine powder compared to mixing with the fine powder of zinc oxide only. Mixing ratios of the zinc oxide fine powder and the metallic zinc fine powder are preferably 90–50 weight % of the former and 10–50 weight % of the latter, especially 90–70 weight % of the former and 10–30 weight % of the latter.

The adding amount of the zinc oxide fine powder or the mixture of zinc oxide fine powder and metallic zinc fine powder is 0.1–5 weight parts, preferably 0.5–3 weight parts per 100 weight parts of the mother alloy powder for permanent magnets (c.f. Examples to be mentioned later). The added amount of smaller than 0.1 weight parts exhibits little effect and that of larger than 5 weight parts exhibits no specific merits. Zinc may either be evaporated completely or be retained up to about 0.3 weight % in the sintered permanent magnet.

Fine powder of Nd may be added in combination with the fine powder of zinc oxide or with the mixture of fine powder of zinc oxide and fine powder of metallic zinc. The adding amount of the fine powder of Nd is preferably 0.1–2.5 weight parts per 100 weight parts of the mother alloy powder for permanent magnet.

The smaller the better for particle sizes of the mother alloy fine powder or zinc oxide fine powder used. Average particle sizes of not larger than 5 μm for the mother alloy fine powder and not larger than 2 μm for the zinc oxide fine powder are preferred. Such a zinc oxide fine powder is obtainable by the vapor-phase oxidation of metallic zinc vapor.

Degree of vacuum for the sintering is preferably set at around $10^{-5}$–$10^{-6}$ Torr. The sintering in vacuum is preferably conducted at 1000–1100° C. Due to the heating, the zinc oxide decomposes thermally into metallic zinc and oxygen, and the metallic zinc forms a liquid phase at grain boundaries of the mother alloy crystal. A portion of the mother alloy component especially rare-earth elements is segregated at the boundary and inside of the mother alloy crystal, and oxidation of the segregated mother alloy component especially rare earth elements with oxygen formed by the thermal decomposition of zinc oxide occurs to form firstly amorphous metal oxides and then the amorphous metal oxide crystallizes to conjugate epitaxially with the mother alloy crystals. In contrast to forming sintered materials by sintering under mere addition of rare-earth element oxides, in the liquid-solid phase sintering reaction under the pressure of decomposed oxygen, metals, especially rare-earth element, segregated at the boundary and inside of mother alloy crystal or added fine powder of Nd is subjected to forced oxidation, and the mother alloy crystal constituting the principal magnetic phase and the metal oxide crystal phase forms an epitaxial junction to orient the mother alloy crystals. Due to the reaction procedure, it becomes possible to enlarge the coercive force (Hc) and enlarge residual magnetic flux density (Br) by maintaining the single magnetic domain in the mother alloy crystal, by hindering the movement of magnetic walls under application of magnetic field, and by preventing generation of magnetic domains causing inversion of magnetic domains. The reason why incorporation of a mixture of zinc oxide fine powder and metallic zinc fine powder to the mother alloy powder brings better results than incorporation of zinc oxide fine powder only is guessed as that, since the metallic zinc liquefies at a relatively low temperature, segregation of metals existing at grain boundaries of the mother alloy crystal, specifically segregation of Nd, proceeds at relatively earlier stage. The zinc evaporates completely or substantially into vacuum at the end. In this connection, the melting point and boiling point of zinc is 419° C. and 930° C., respectively.

Under insufficient sintering, the amorphous metal oxide sometimes unable to crystallize completely and the amorphous metal oxide may remain partially at the boundary and inside of the mother alloy crystal.

In this case, the more the epitaxial junction between the mother alloy crystal constituting the magnetic phase and the metal oxide crystal phase exists, the more the improvement in the magnetic property becomes so recognizable.

After sintering in vacuum, the sintered material is quenched usually by making contact with an inert gas stream.

The embodiments and effect of the present invention will be explained based on Examples, however, the invention never be restricted by the Examples.

EXAMPLES 1–3

One hundred weight parts of a crystalline (tetragonal) alloy (mother alloy) powder (average particle diameter 3 μm) for permanent magnets having basically $Nd_2Fe_{14}B$ composition (corresponding to Nd: about 12 atomic %; Fe: about 82 atomic %; B: about 6 atomic %) substituted partially the Fe with Co and the Nd with Pr was mixed fully with 1 weight part, 2.5 weight parts or 5 weight parts of fine powder (average particle diameter 0.1 μm) of zinc oxide, and the mixture was subjected to compaction molding under 2 t/cm$^2$ pressure and 30 OkOe magnetic field, sintering under $10^{-5}$ Torr vacuum for about 1 hour at around 1080° C., and the sintered material was quenched by contacting with Ar gas stream to obtain a sintered permanent magnet. Zinc formed during the process was vaporized entirely into vacuum by controlling temperatures and lengths of time for the sintering step. Magnetic properties measured for the sintered permanent magnets obtained are mentioned in Table 1.

EXAMPLES 4–6

One hundred weight parts of the same mother alloy powder as used for Example 1 was mixed fully with 1 weight part, 2.5 weight parts or 5 weight parts of a mixture of 80 weight % fine powder of zinc oxide and 20 weight % fine powder of metallic zinc, and the mixture was subjected to compaction molding under 2t/cm$^2$ pressure and 30 kOe magnetic field, sintering under $10^{-5}$ Torr vacuum for about 1 hour at around 1080° C., and the sintered material was quenched by contacting with Ar gas stream to obtain a sintered permanent magnet. The entire zinc formed during the process was vaporized into vacuum by controlling temperatures and lengths of time for the sintering step. Magnetic properties measured for the sintered permanent magnet obtained are mentioned in Table 1.

EXAMPLES 7–9

One hundred weight parts of the same mother alloy powder as used for Example 1 was mixed fully with 1 weight part, 2.5 weight parts or 5 weight parts of a mixture of 50 weight % fine powder of zinc oxide and 50 weight % fine powder of metallic zinc, and the mixture was subjected to compaction molding under 2t/cm$^2$ pressure and 30 kOe magnetic field, sintering under$10^{-5}$ Torr vacuum for about 1 hour at around 1080° C., and the sintered material was quenched by contacting with Ar gas stream to obtain a sintered permanent magnet. The entire zinc formed during the process was vaporized into vacuum by controlling temperatures and lengths of time for the sintering step. Magnetic properties measured for the sintered permanent magnet obtained are mentioned in Table 1.

Comparative Examples 1

The same mother alloy powder for permanent magnet as used for Example 1 was subjected solely to compaction molding under 2 t/cm$^2$ pressure and 30 kOe magnetic field, sintering under $10^{-5}$ Torr vacuum for about 1 hour at around 1080° C., and the sintered material was quenched by contacting with Ar gas stream to obtain a sintered permanent magnet. Magnetic properties measured for the sintered permanent magnet obtained are mentioned in Table 1.

Comparative Examples 2–4

One hundred weight parts of the same mother alloy powder for permanent magnet as used for Example 1 was mixed fully with 1 weight part, 2.5 weight parts or 5 weight parts of fine powder of metallic zinc, and the mixture was subjected to compaction molding under 2t/cm$^2$ pressure and 30 kOe magnetic field, sintering under 10 5 Torr vacuum for about 1 hour at around 1080 ° C., and the sintered material was quenched by contacting with Ar gas stream to obtain a sintered permanent magnet. The entire zinc formed during the process was vaporized into vacuum by controlling temperatures and lengths of time for the sintering step. Magnetic properties measured for the sintered permanent magnet obtained are mentioned in Table 1.

TABLE 1

| | Composition of added powder | Added amount wt % | Retained Zn wt % | (BH)max MGOe |
|---|---|---|---|---|
| Example 1 | ZnO(100%) | 1.0 | 0 | 51.0 |
| Example 2 | ZnO(100%) | 2.5 | 0 | 50.8 |
| Example 3 | ZnO(100%) | 5.0 | 0 | 51.8 |
| Example 4 | ZnO(80%) + Zn(20%) | 1.0 | 0 | 66.2 |
| Example 5 | ZnO(80%) + Zn(20%) | 2.5 | 0 | 64.3 |
| Example 6 | ZnO(80%) + Zn(20%) | 5.0 | 0 | 51.7 |
| Example 7 | ZnO(50%) + Zn(50%) | 1.0 | 0 | 61.5 |
| Example 8 | ZnO(50%) + Zn(50%) | 2.5 | 0 | 58.8 |
| Example 9 | ZnO(50%) + Zn(50%) | 5.0 | 0 | 51.4 |
| Comp. Ex. 1 | | none | — | 45.3 |
| Comp. Ex. 2 | Zn(100%) | 1.0 | 0 | 46.2 |
| Comp. Ex. 3 | Zn(100%) | 2.5 | 0 | 45.6 |
| Comp. Ex. 4 | Zn(100%) | 5.0 | 0 | 44.1 |

Figure 2:
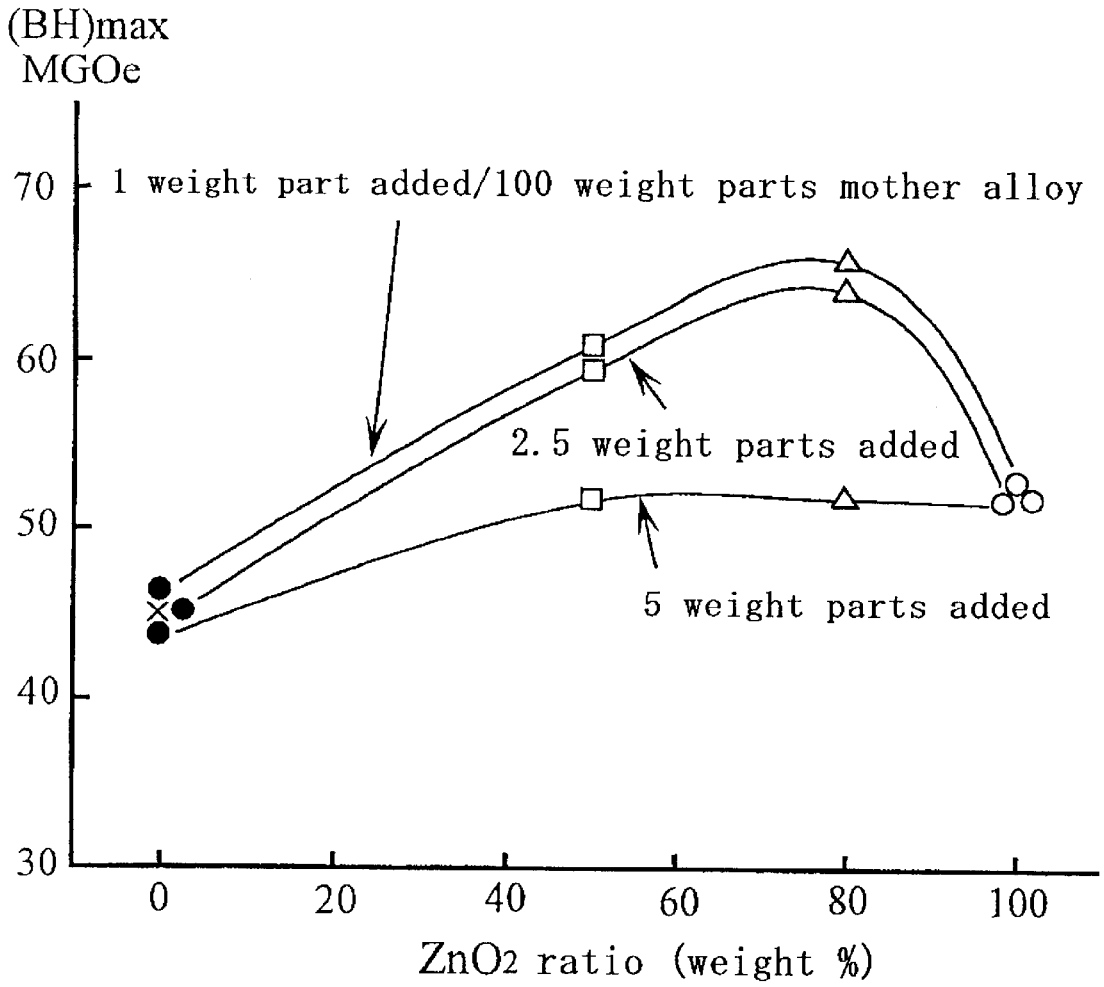
FIG. 2 is a graph showing magnetic properties of the sintered permanent magnet obtained by Examples 1–9 and Comparative Examples 1–4, in which the abscissa indicates the mixing ratio (weight ratio) of zinc oxide and zinc, and the ordinate indicates the maximum energy product (BH) max.

Based on a graphic representation of the data shown in Table 1, mentions are made hereunder by use of the attached FIGS. 1 and 2 on relationships between the magnetic properties, especially on the maximum energy product (BH) max and preparing conditions for the sintered permanent magnets mentioned in Examples 1–9 and Comparative Examples 1–4.

In FIG. 1, the abscissa indicates amount (weight) of the zinc oxide, mixture of zinc oxide and metallic zinc or metallic zinc added to 100 weight parts of the mother alloy; and the ordinate indicates the maximum energy product (BH)max. When metallic zinc is added to the mother alloy (•: Comp. Exs. 2, 3 and4), no improvement in (BH)max is noticed compared with the mother alloy sintered by itself (×:Comp. Ex. 1) regardless of the amount of metallic zinc added. On the other hand when the zinc oxide is added (○: Exs. 1, 2 and 3), overall improvement in (BH)max is noticed. Further, addition of mixtures of zinc oxide and metallic zinc, especially addition of the mixture of 80 % zinc oxide and 20% metallic zinc (Δ: Exs. 4, 5 and6), increases the (BH)max remarkably. Addition of the mixture of 50% zinc oxide and 50% metallic zinc (□: Exs. 7, 8 and 9) provides a result intermediate between the result of adding solely zinc oxide (○) and that of adding the mixture of 80% zinc oxide and 20% metallic (A). Minimum amounts of the additive per 100 weight parts of the mother alloy for showing increases in the (BH) max is around 0.1–0.2 weight parts in any case, and the maximum effect is available by between 0.5–3 weight parts, especially by 0.5–2.5 weight parts, for the maximum effect. Addition of above 5 weight parts shows no particular effect.

In FIG. 2, the abscissa indicates mixing ratios (weight %) of the zinc oxide and metallic zinc, and the ordinate indicates the maximum energy product (BH) max. It is understandable there from that, when the amount added is the same, the peak (BH)max is available at around 80 weight % zinc oxide and 20 weight % metallic zinc, and rather high (BH)max is available at 90–50weight % zinc oxide fine powder and 10–50 weight % metallic zinc fine powder, and 1 weight part for the total amount of the additive is enough for 100 weight parts of the mother alloy.

EXAMPLE 10

One hundred weight parts of the same mother alloy powder as used for Example 1 was mixed fully with 2.5 weight parts of a mixture of 80 weight % fine powder of zinc oxide and 20 weight % fine powder of metallic zinc, and the mixture was subjected to compaction molding under 2t/cm$^2$ pressure and 30 kOe magnetic field, sintering under $10^{-5}$ Torr vacuum for about 1 hour at around 1080° C., and the sintered material was quenched by contacting with Ar gas stream to obtain a sintered permanent magnet. During the process, the sintering temperature and length of time was so controlled as to retain 0.25 weight part of zinc in the sintered permanent magnet and vaporize the rest of the metallic zinc into the vacuum. The maximum energy product (BH)max of thus obtained sintered permanent magnet was 64.0 MGOe (megaoersted), which was almost the same with that no metallic zinc was retained (Example 5).

COMPARATIVE EXAMPLE5

One hundred weight parts of the same mother alloy powder as used for Example 1 was mixed fully with 2.5 weight parts of neodymium oxide ($Nd_2O_3$), and the mixture was subjected to compaction molding under 2t/cm$^2$ pressure and 30 kOe magnetic field, sintering under $10^{-5}$ Torr vacuum for about 1 hour at around 1080° C., and the sintered material was quenched by contacting with Ar gas stream to obtain a sintered permanent magnet. The maximum energy product (BH)max of thus obtained sintered permanent magnet was 45.5 MGOe, which was almost the same with that no neodymium oxide was added (Comparative Example 1).

EXAMPLE 11

One hundred weight parts of the same mother alloy powder as used for Example 1 was mixed fully with 1.0 weight parts of metallic Nd fine powder and 2.5 weight parts of mixture of 80 weight % fine powder of zinc oxide and 20 weight % fine powder of metallic zinc, and the mixture was subjected to compaction molding under 2t/cm pressure and 30 kOe magnetic field, sintering under $10^{-5}$ Torr vacuum for about 1 hour at around 1080 ° C., and the sintered material was quenched by contacting with Ar gas stream to obtain a sintered permanent magnet. During the process, the sintering temperature and length of time was so controlled as to vaporize the zinc into vacuum. The maximum energy product (BH)max of thus obtained sintered permanent magnet was 65.2 MGOe.

Figure 3:
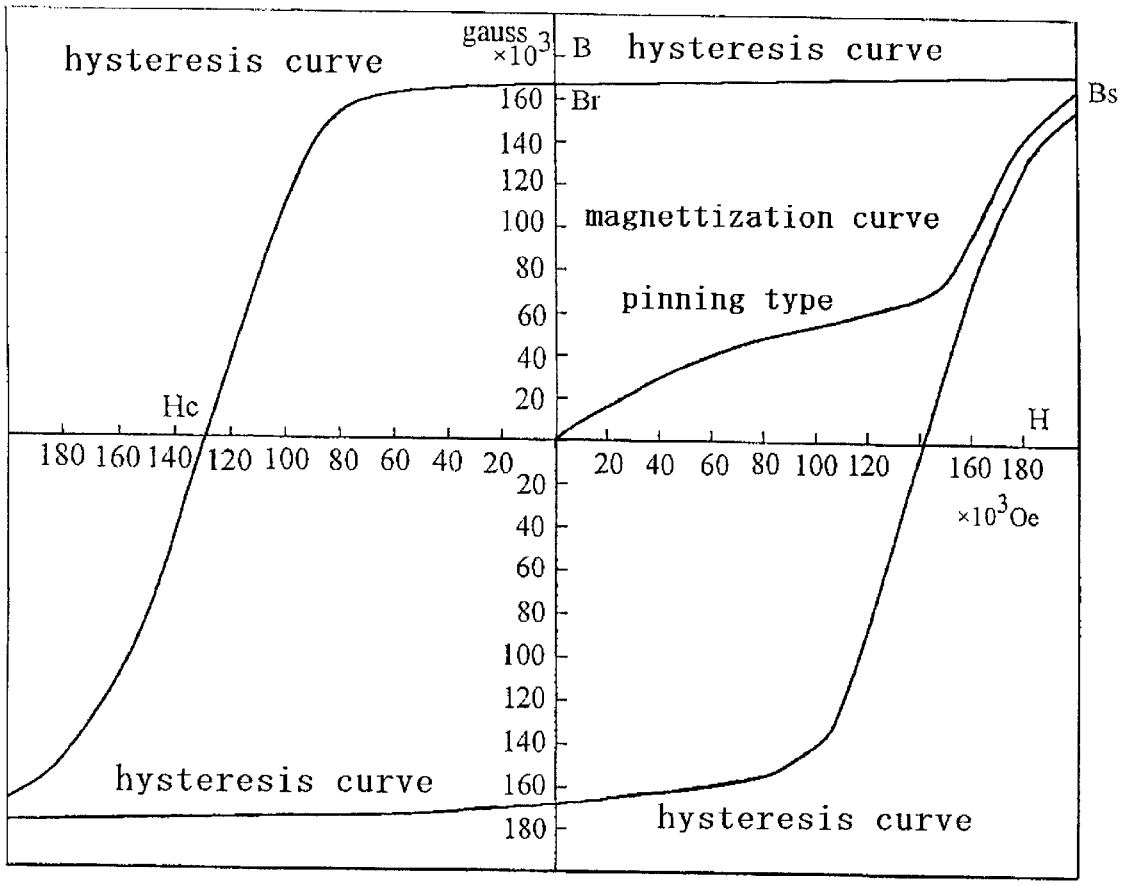
FIG. 3 is a graph showing the magnetization curve and hysteresis curve of the sintered permanent magnet of Example 4.
Figure 4:
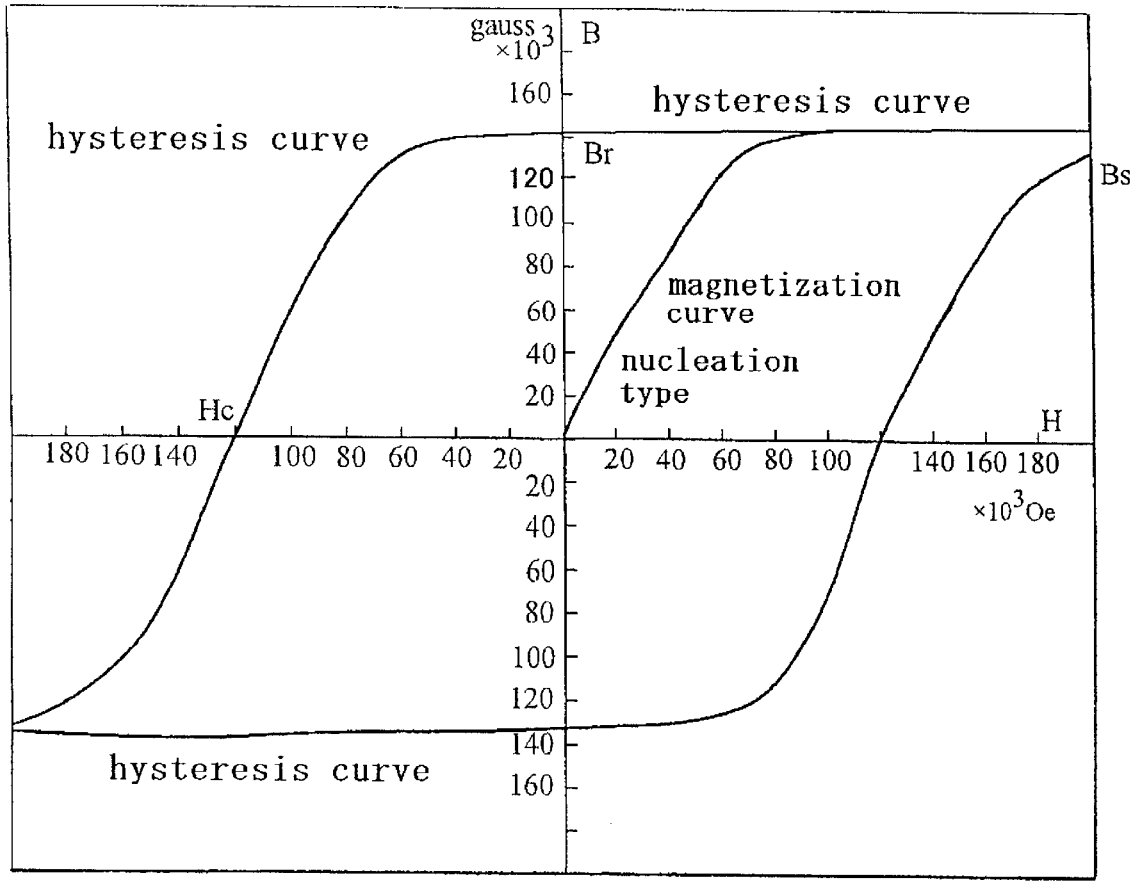
FIG. 4 is a graph showing the magnetization curve and hysteresis curve of the sintered permanent magnet of Comparative Example 1.

FIG. 3 shows a magnetization curve and a hysteresis curve of the sintered permanent magnet of Example 4, and FIG. 4 shows a magnetization curve and a hysteresis curve of the sintered permanent magnet of Comparative Example 1. The magnetization curve of FIG. 4 (Comparative Example 1) rises rapidly and reaches to saturated value (saturation flux density: Bs) smoothly. Whereas, the magnetization curve of FIG. 3 (Example 4) rises slowly at first, and then turns to rise rapidly to reach to a higher saturated value (saturation flux density: Bs) compared to that of FIG. 4 (Comparative Example 1). Further, hysteresis curve of FIG. 3 (Example 4) shows a wider locus with higher Br and Hc values compared to those of hysteresis curve of FIG. 4 (Comparative Example 1) resulting to a higher (BH)max. These two types are already known for Sm—Co magnet. A type in which the magnetization curve rises rapidly (represented by $SmCo_5$) is called as nucleation type, and another type in which the magnetization curve rises slowly at first, and then turns to rise rapidly (represented by $Sm_2Co_{17}$) is called as pinning type, and they have different crystal structures. As for ReFeB magnet, the nucleation type is already known, but the pinning type is not known heretofore. The sintered permanent magnet of the present invention is a first example of pinning type ReFeB magnet.

What is claimed is:

1. A method for preparation of sintered permanent magnets comprising the steps of:

mixing fully fine powder of a crystalline mother alloy for permanent magnet containing a rare-earth element, Fe and B as the essential components with fine powder of zinc oxide, compaction molding the resulted mixture in the presence of a magnetic field, sintering the compacted mixture in vacuum to cause generation of oxygen and metallic zinc by thermal decomposition of the zinc oxide; segregation of a part of metallic component in the mother alloy at the boundary and inside of the mother alloy crystal; formation of amorphous metallic oxide by forced oxidation of the segregated metal with the generated oxygen; crystallization of the amorphous metallic oxide; formation of an epitaxial junction between the crystallized metallic oxide and the mother alloy crystal; and evaporation of the metallic zinc into the vacuum, and quenching the sintered compact.

2. A method for preparation of sintered permanent magnets comprising the steps of:

mixing fully fine powder of a crystalline mother alloy for permanent magnet containing a rare-earth element, Fe and B as the essential components with a mixture of fine powder of zinc oxide and fine powder of metallic zinc, compaction molding the resulted mixture in the presence of a magnetic field, sintering the compacted mixture in vacuum to cause generation of oxygen and metallic zinc by thermal decomposition of the zinc oxide; segregation of a part of metallic component in the mother alloy at the boundary and inside of the mother alloy crystal; formation of amorphous metallic oxide by forced oxidation of the segregated metal with the generated oxygen; crystallization of the amorphous metallic oxide; formation of an epitaxial junction between the crystallized metallic oxide and the mother alloy crystal; and evaporation of the metallic zinc into the vacuum, and quenching the sintered compact.

3. A method for preparation of sintered permanent magnets according to claim 1 or 2, wherein the rare-earth element contained in the mother alloy for permanent magnet is principally Nd.

4. A method for preparation of sintered permanent magnets according to claim 1 or 2, wherein the mother alloy for permanent magnet is a NdFeB compound or a NdFeCoB compound having a tetragonal crystal phase with the lattice constant Ao of about 8.8 Å and the lattice constant $C_0$ of about 12 Å as the major phase.

5. A method for preparation of sintered permanent magnets according to claim 1, wherein 0.1–5 weight parts of zinc oxide fine powder is mixed with 100 weight parts of the mother alloy fine powder for permanent magnet.

6. A method for preparation of sintered permanent magnets according to claim 2, wherein 0.1–5 weight parts of the mixture of zinc oxide fine powder and metallic zinc fine powder is mixed with 100 weight parts of the mother alloy fine powder for permanent magnet.

7. A method for preparation of sintered permanent magnets according to claim 1 or 2, wherein the mother alloy powder having average particle diameter of not larger than 5 $\mu$m and the zinc oxide fine powder having average particle diameter of not larger than 2 $\mu$m is used.

8. A method for preparation of sintered permanent magnets according to claim 1 or 2, wherein the sintering in vacuum is conducted at 1000–1100° C.

9. A method for preparation of sintered permanent magnets according to claim 1 or 2, wherein the sintered compact is quenched by contacting with an inert gas stream.

10. A method for preparation of sintered permanent magnets according to claim 1 or 2, wherein metallic zinc formed during the sintering is evaporated entirely.

11. A method for preparation of sintered permanent magnets according to claim 1 or 2, wherein a portion of metallic zinc formed during the sintering is retained in the sintered permanent magnet.

12. A method for preparation of sintered permanent magnets according to claim 2, wherein a mixture of 90–50 weight % zinc oxide fine powder and 10–50 weight % metallic zinc fine powder is used.

13. A method for preparation of sintered permanent magnets according to claim 1 or 2, wherein 0.1–2.5 weight parts Nd fine powder is mixed with 100 weight parts fine powder of the mother alloy for permanent magnet.

14. A method for preparation of sintered permanent magnets according to claim 1 or 2, wherein Fe in the mother alloy is substituted partially with another transition metals.

* * * * *